US007298073B2

(12) United States Patent
Yonezawa et al.

(10) Patent No.: US 7,298,073 B2
(45) Date of Patent: Nov. 20, 2007

(54) ELECTRON TUBE WITH STEPPED FIXING PORTION

(75) Inventors: Yoshihisa Yonezawa, Mobara (JP); Yasuhiro Nohara, Mobara (JP); Hiroaki Kawasaki, Mobara (JP)

(73) Assignee: Futaba Corporation, Mobara-shi, Chiba-ken (JP)

( * ) Notice: Subject to any disclaimer, the term of this patent is extended or adjusted under 35 U.S.C. 154(b) by 222 days.

(21) Appl. No.: 10/770,173

(22) Filed: Feb. 2, 2004

(65) Prior Publication Data

US 2004/0150323 A1 Aug. 5, 2004

(30) Foreign Application Priority Data

Feb. 3, 2003 (JP) ..... 2003-026427

(51) Int. Cl.
*H01J 1/00* (2006.01)
*H01J 1/18* (2006.01)
*H01J 19/00* (2006.01)

(52) U.S. Cl. ..... 313/292; 313/495; 313/238; 313/271

(58) Field of Classification Search ..... 313/495, 313/271, 272, 238, 292
See application file for complete search history.

(56) References Cited

U.S. PATENT DOCUMENTS 3,784,862 A 1/1974 Yoshitoshi et al.
3,906,277 A 9/1975 Schade
4,263,700 A 4/1981 Fujisaki et al.
5,667,418 A 9/1997 Fahlen et al.
6,856,085 B2 * 2/2005 Yonezawa et al. ..... 313/495
2002/0113543 A1 * 8/2002 Yonezawa et al. ..... 313/495
2002/0121857 A1 * 9/2002 Yonezawa et al. ..... 313/495
2004/0150321 A1 * 8/2004 Yonezawa et al. ..... 313/495

FOREIGN PATENT DOCUMENTS

| | | |
|---|---|---|
| DE | 27-43423 | 4/1979 |
| GB | 2074370 A1 | 10/1981 |
| JP | 04-324236 | 11/1992 |
| JP | 6-88043 | 12/1994 |
| JP | 2002-245925 | 8/2002 |
| JP | 2002-260521 | 9/2002 |

* cited by examiner

*Primary Examiner*—Joseph Williams
*Assistant Examiner*—Kevin Quarterman
(74) *Attorney, Agent, or Firm*—Quarles & Brady LLP

(57) ABSTRACT

In a fluorescent display tube, a metal spacer is used as a height sustaining member and a fixing member of linear member so that the fixing strength of the linear member in the lengthwise direction is increased. In the fluorescent display tube, both ends of filament and Al wires are bonded onto a cathode electrode formed on a substrate by ultrasonic bonding. The ends of the filament are embedded in a part in the Al wires in the shape of being bent into a letter Z or an inverted letter Z to form fixing portion.

12 Claims, 8 Drawing Sheets

ELECTRON TUBE WITH STEPPED FIXING PORTION

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

The present invention relates to an electron tube having a linear member, such as a cathode filament, a linear grid, a linear damper for the cathode filament or for the linear grid, and a linear spacer for the cathode filament or for the linear grid. More particularly, the present invention relates to a fixing structure of the linear member in a fluorescent luminous tube, such as a fluorescent display tube in which the linear member is mounted under tension.

2. Description of the Prior Art

A fluorescent display tube, as a kind of a conventional electron tube shown in Japanese Patent Laid-Open Publication No. 2002-245925, will be described with reference to FIGS. 8(*a*) and 8(*b*). FIG. 8(*a*) is a cross-sectional view illustrating a fluorescent display tube taken along the line X2-X2 in FIG. 8(*b*) looking in the directions of the arrow. FIG. 8(*b*) is a cross-sectional view illustrating the fluorescent display tube taken along the line X1-X1 in FIG. 8(*a*) looking in the direction of the arrow.

The fluorescent display tube has a hermetic container formed of substrates 111 and 112 to be opposite to each other, and side plates 121 to 124. The hermetic container contains filaments 23, a grid 33, and an anode electrode 31 therein. Electrons emitted from the filaments 23 are controlled by the grid 33 to reach the anode electrode 31, and the reached electrons excite fluorescent material on the anode electrode 31 to make the fluorescent material emit light.

A pair of aluminum (Al) thin films 211 and 212 for use as a cathode electrode is formed on the substrate 111. The ends of the filament 23 are held between the Al thin film 211 and an Al wire 251, and the Al thin film 212 and the Al wire 252, and bonded to the Al thin films 211 and 212 and the Al wires 251 and 252 by ultrasonic bonding. Spacers 261 and 262 made of an Al wire sustain the filament 23 at a predetermined elevated height.

The conventional fluorescent display tube shown in FIGS. 8(*a*) and 8(*b*) requires to dispose therein the filament 23 having both side ends thereof fixed between the Al thin film 211 and the Al wire 251 and the Al thin film 212 and the Al wire 252 respectively, as well as the spacers 261 and 262 for sustaining the filament 23 at the predetermined elevated height. This results in increasing dead space in the fluorescent display tube, and is obstructive to reduce the size of the fluorescent display tube.

Moreover, the filament 23 merely touches the spacers 261 and 262 and are not fixed to the spacers 261 and 262. Thus, the filament 23 is liable to sideslip in the lengthwise directions of the spacers 261 and 262 while the fluorescent display tube is being assembled or being used. The sideslip changes the light emission of the fluorescent material on the anode electrodes 31 and deteriorates the display quality of the fluorescent display tube.

The conventional fluorescent display tube separately arranges the Al wires 251 and 252 for fixing the filaments 23, and the spacers 261 and 262 for sustaining the filaments 23 at the predetermined elevated height. In other words, the conventional fluorescent display tube requires the Al wires 251 and 252 for fixing the filaments 23, and the Al spacer wires 261 and 262.

SUMMARY OF THE INVENTION

The present invention has been made in view of the foregoing disadvantages of the prior art.

Accordingly, an object of the present invention is to provide an electron tube in which Al wires for fixing ends of linear filament and spacers are integrated so as to reduce dead space of the electron tube and to decrease the number of the Al wires for fixing the linear filament and the spacers for sustaining the filament.

According to a first aspect of the present invention, an electron tube comprises a container for containing electrodes therein; a linear member mounted inside the container; conductive spacers for keeping the linear member at a predetermined height in the container, the linear member being held by the conductive spacers to have at least one end of the linear member fixed to each of the conductive spacers; and conductive layers formed inside the container for fixing the conductive spacers thereon, wherein both ends of the linear member are fixed to a fixing portion of the conductive spacers along stepped surfaces of the fixing portion.

According to a second aspect of the present invention, an electron tube comprises a container for containing electrodes therein; a linear member mounted inside the container; conductive spacers for keeping the linear member at a predetermined height in the container, the linear member being held by the conductive spacers to have at least one end of the linear member fixed to each of the conductive spacers; and conductive layers formed inside the container for fixing the conductive spacers thereon, wherein the conductive spacers each include a stepped fixing portion to which the linear member is fixed along the stepped surfaces of the fixing portion.

According to the present invention, the linear member comprises a cathode filament, a linear damper, a linear spacer, a linear grid or a linear getter. The linear member is bonded to the fixing portion along the stepped surface thereof by ultrasonic bonding. Furthermore, the liner member is fixed to the fixing portion in a state in which at least a part of the linear member is embedded in the fixing portion.

BRIEF DESCRIPTION OF THE DRAWINGS

This and other objects, features, and advantages of the present invention will become more apparent upon a reading of the following detailed description and drawings, in which.

DETAILED DESCRIPTION OF THE PREFERRED EMBODIMENT

Figure 1A:
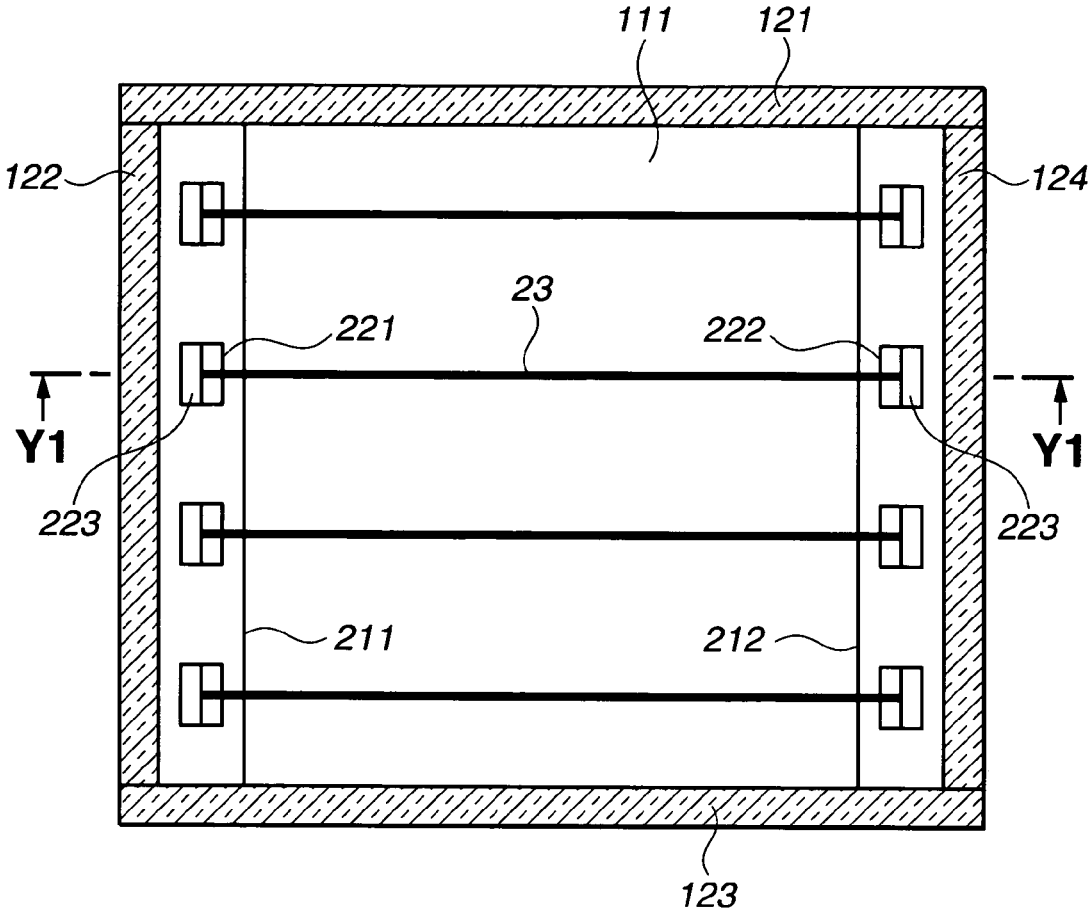
FIGS. 1(*a*) and 1(*b*) are cross sectional views, each showing a fluorescent display tube according to a first embodiment of the present invention.

A fluorescent display tube, as an example of an electron tube, according to the preferred embodiments of the present invention, will be described hereinafter with reference to FIGS. 1(*a*) to 7(*b*). Same reference numerals are used to show the common constituent elements. When there is a plurality of the same constituent elements, a typical element is indicated by the reference numeral.

Figure 1B:
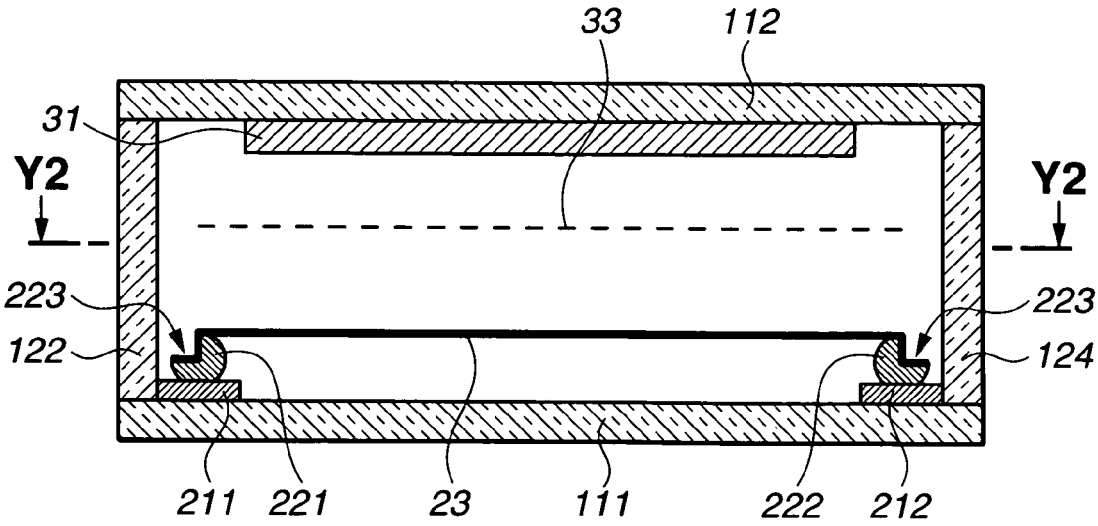
Figure 2A:
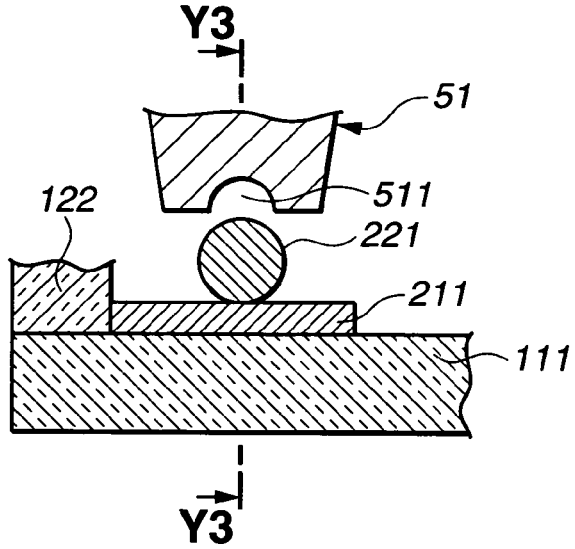
FIGS. 2(*a*), 2(*b*), 2(*c*), 2(*d*), 2(*e*), and 2(*f*) show a process of fixing a filament and an Al wire separately.
Figure 2B:
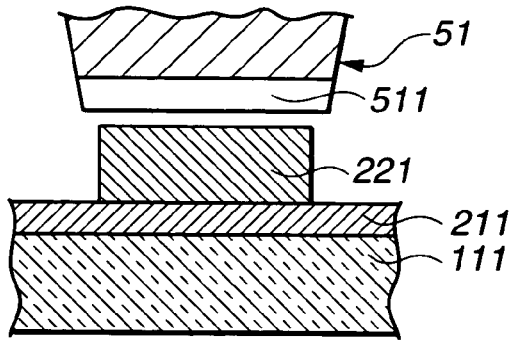
Figure 2C:
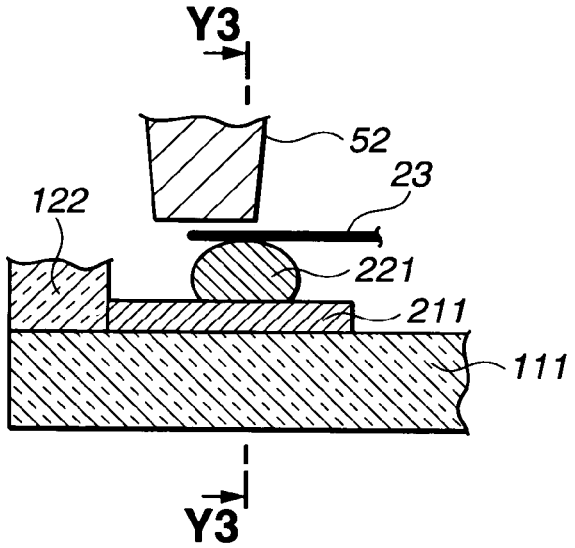
Figure 2D:
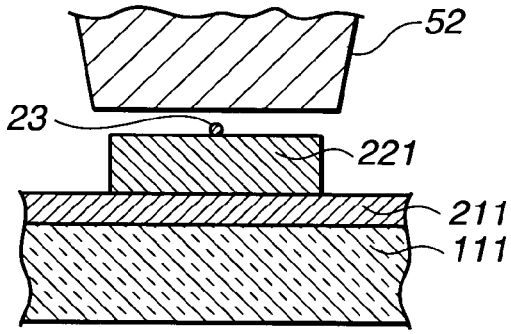
Figure 2E:
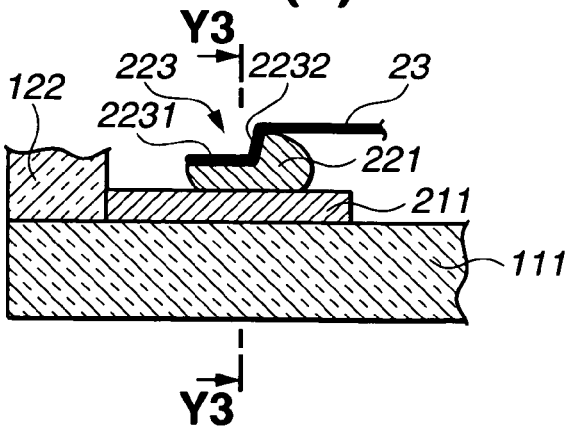
Figure 2F:
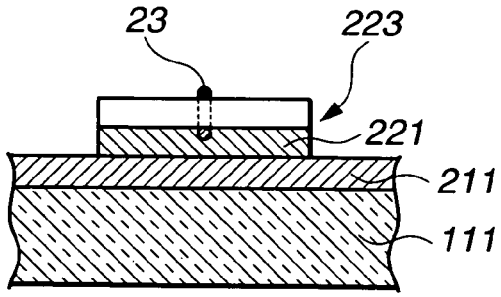
Figure 3A:
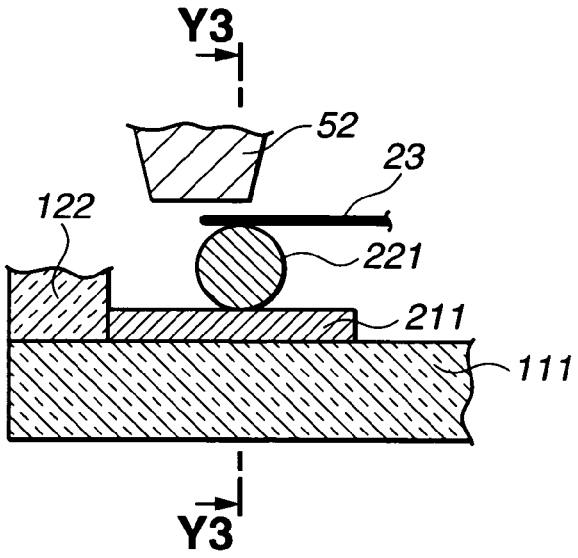
FIGS. 3(*a*), 3(*b*), 3(*c*), and 3(*d*) show a process of fixing a filament and an Al wire at the same time.
Figure 3B:
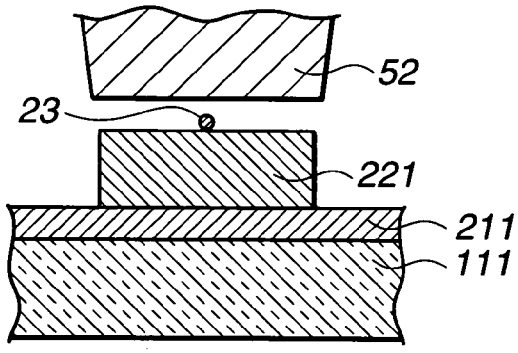
Figure 3C:
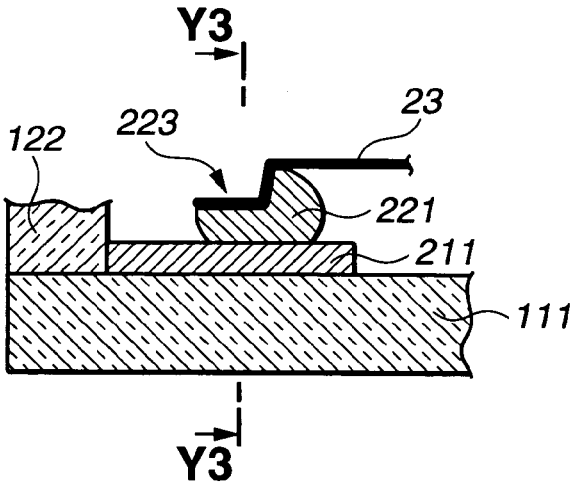
Figure 3D:
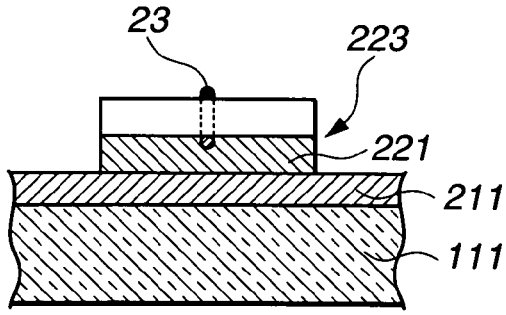
Figure 4A:
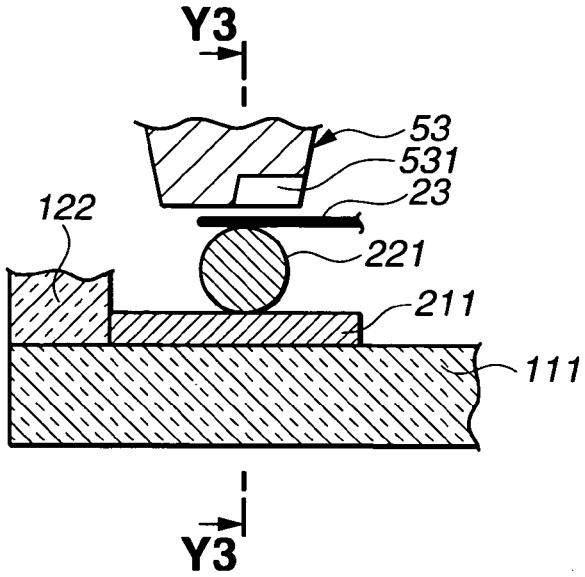
FIGS. 4(*a*), 4(*b*), 4(*c*), and 4(*d*) show a process of forming a projection for a spacer on an Al wire.
Figure 4B:
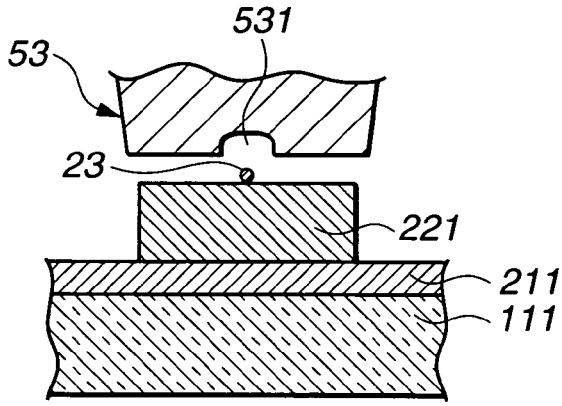
Figure 4C:
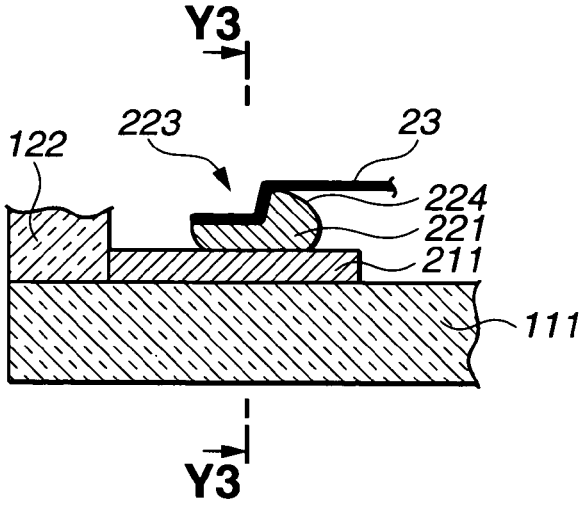
Figure 4D:
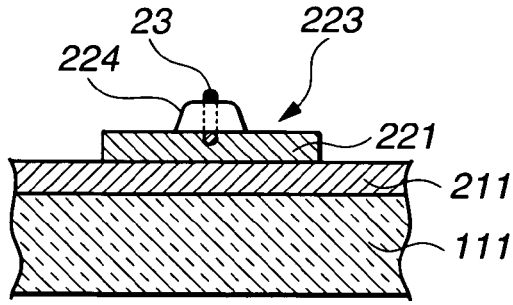
Figure 5A:
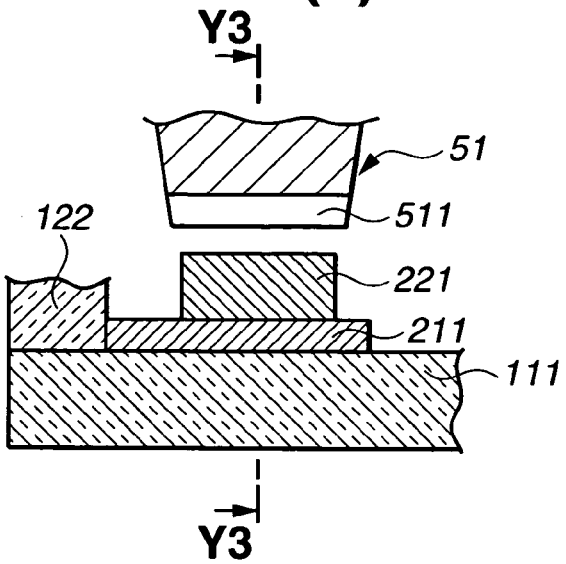
FIGS. 5(*a*), 5(*b*), 5(*c*), 5(*d*), 5(*e*), and 5(*f*) show a process of arranging and fixing a filament and an Al wire in order that the lengthwise direction of the filament and the Al wire may be the same.
Figure 5B:
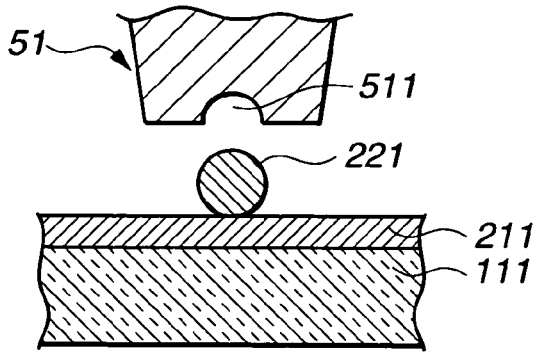
Figure 5C:
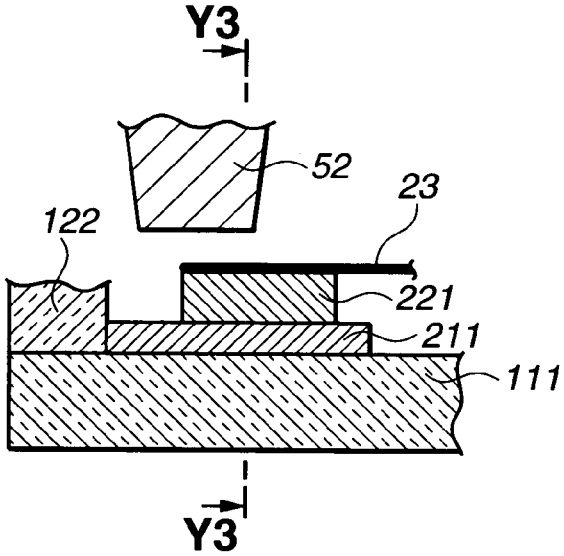
Figure 5D:
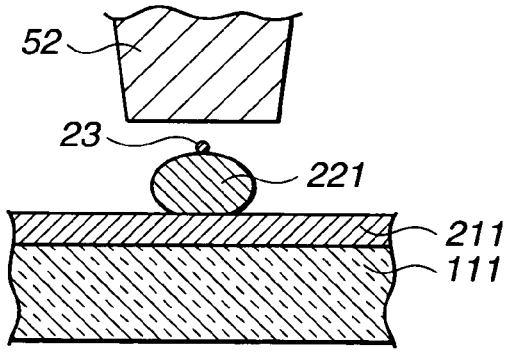
Figure 5E:
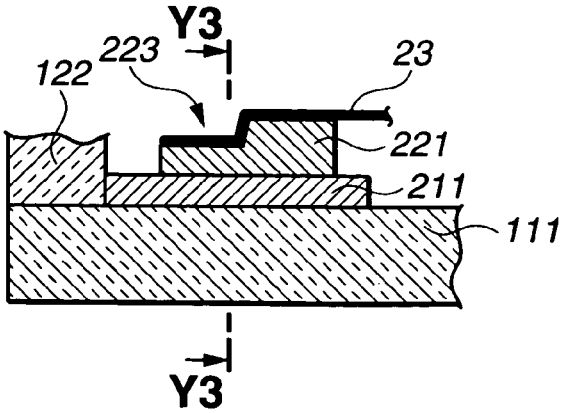
Figure 5F:
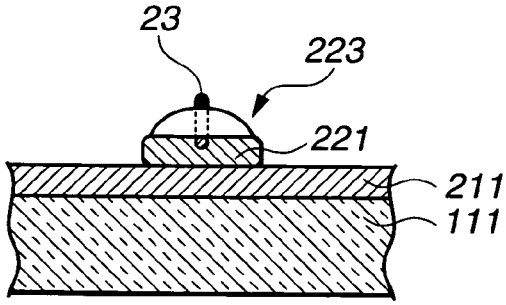
Figure 6A:
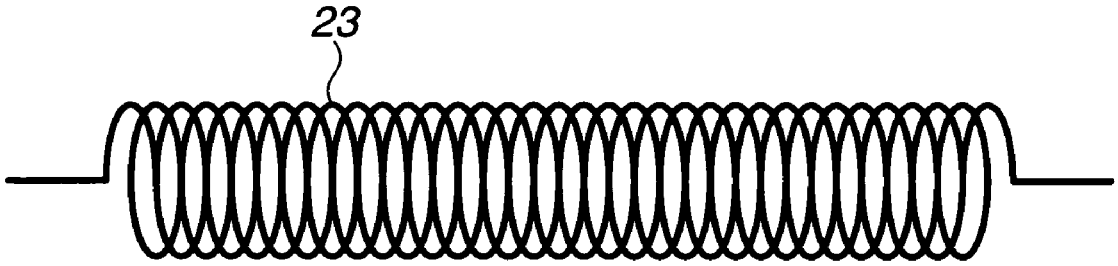
FIGS. 6(*a*), 6(*b*), 6(*c*), and 6(*d*) show showing a shape of the filament in detail used in the fluorescent display tube of FIG. 1.
Figure 6B:
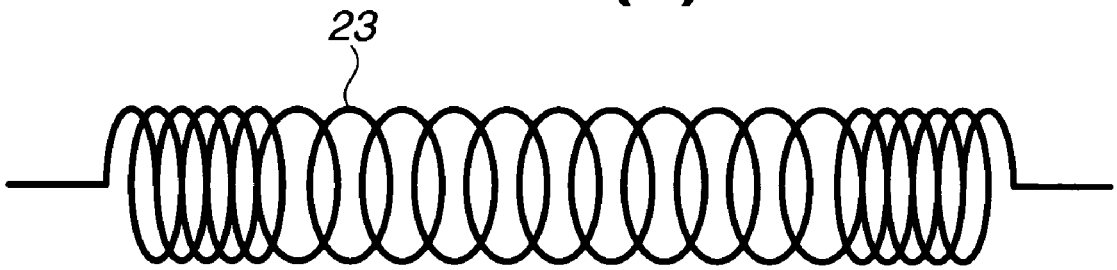
Figure 6C:
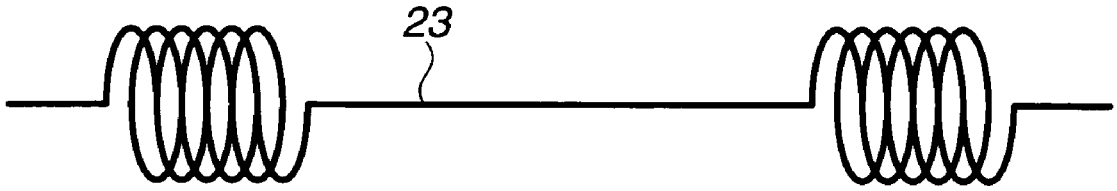
Figure 6D:
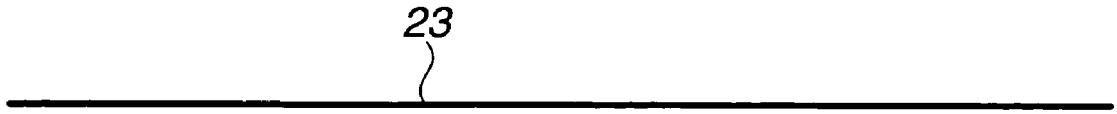

FIGS. 1(*a*) and (*b*) are cross sectional views showing a fluorescent display tube according to a first embodiment of the present invention. FIG. 1(*a*) is a cross sectional view illustrating the fluorescent display tube taken along the line Y2-Y2 in FIG. 1(*b*) looking in the direction of the arrow. FIG. 1(*b*) is a cross sectional view illustrating the fluorescent display tube of FIG. 1(*a*), taken along the line Y1-Y1 in FIG. 1(*a*) looking in the direction of the arrow.

The fluorescent display tube shown in FIGS. 1(*a*) and 1(*b*) includes a hermetic container provided with at least a first and second insulating substrates 111 and 112, which are opposed to each other and are made of glass, a ceramic or the like. The substrates 111 and 112 are sealed by insulating side plates 121 to 124 made of glass, a ceramic or the like, using a frit glass (not shown) to form the hermetic container. The hermetic container may be fabricated by sealing the substrates 111 and 112 using only the frit glass without using the side plates 121 to 124. Accordingly, the side plates 121 to 124 including the frit glass are referred to as a side member.

Inside the hermetic container, there are linear thermionic cathode filaments 23, a grid 33 formed of a metal mesh, metal wires or the like, and an anode electrode 31 made of a metal, the surface of which a fluorescent material is coated. Electrons emitted from the filaments 23 are controlled by the grid 33 to reach the anode electrode 31, and excite the fluorescent material on the anode electrode 31 to emit light. In the fluorescent display tube shown in FIGS. 1(*a*) and 1(*b*), a transparent or translucent glass plate is used as at least at one of the substrates 111 and 112 from which light emission of the fluorescent material on the anode electrodes 31 is viewed.

A pair of Al thin films 211 and 212 for use in the cathode electrode is formed on the substrate 111 common to four filaments 23. The pair of the Al thin films 211 and 212 may be separately formed in each filament. A nesa electrode (not shown) is formed between the Al thin films 211 and 212 in the hermetic container.

Al wires 221 and 222 acting as a conductive spacer are fixed to the Al thin films 211 and 212 by ultrasonic bonding. An end of the filaments 23 is bonded to the Al wire 221 by the ultrasonic bonding. Similarly, the other end of the filaments is bonded to the Al wire 222 by ultrasonic bonding. In this structure, the Al wires 221 and 222 are arranged in such a manner that their longitudinal directions intersect the longitudinal direction of the filaments 23.

For fixing the filaments 23 in the fluorescent display tube, the Al wires 221 and 222 are fixed on the Al thin films 211 and 212, respectively, by ultrasonic bonding at first. Next, the filaments 23 stretched across a frame of a jig (not shown) in advance are placed on the fixed Al wires 221 and 222. Then, an ultrasonic bonding tool is made to press a part of one of the filaments 23 and one of the Al wires 221 and 222 to form stepped fixing portions 223 at an offset position of the Al wires 221 and 222 on which the filaments 23 are fixed as it will be described later. Both ends of the filaments 23 are embedded in the fixing portions 223 of the Al wires 221 and 222 along the horizontal and vertical walls thereof, and are bent to have a shape of a letter L or an inverted letter L as shown in FIG. 1(*b*). The filaments 23 are sustained at a predetermined height on the peripheral surfaces of the Al wires 221 and 222 where the fixing portions 223 are not formed. That is, each of the Al wires 221 and 222 includes areas for fixing the filaments 23 and for sustaining the filament 23 at the predetermined height. Accordingly, the Al wires 221 and 222 act as a spacer and also a fixing member of the filaments 23.

The ends of the filaments 23 are bent in the shape of the letter L or the inverted letter L on the fixing portions 223 of the Al wires 221 and 222, and are bent at the tops of the peripheral surfaces of the Al wires 221 and 222 in the direction of stretching the filament 23. In other words, the ends of the filaments 23 are bent into a shape of a letter Z or an inverted letter Z at the fixing portions 223 of the Al wires 221 and 222, and extend in the direction of stretching the filaments 23. As a result, the filaments 23 are hooked at the fixing portions 223 so as to prevent the filaments 23 from coming out of the fixing portions 223, as it will be described later. Furthermore, because the contacting areas of the filaments 23 to the fixing portions 223 increase at the bent portions, a fixing strength of the filaments 23 in the stretched direction is improved.

In place of the grids 33, an intermediate substrate having electron passing apertures and grid electrodes formed in the substrate adjacent to the apertures may be mounted within the hermetic container, and the filaments 23 may be fixed to the intermediate substrate. Furthermore, in place of the filaments 23, a field emission type linear cathode made by coating a carbon nanotube on a metal wire may be used.

In an embodiment of the present invention, the Al thin films 211 and 212 were formed to have a thickness of 0.1 μm or more by sputtering or the like. The Al wires 221 and 222 having a diameter of about 0.1 mm to 1.0 mm can be used. However, the Al wires having a diameter of 0.4 mm were used in this embodiment. The width of the horizontal wall of the fixing portions 223 of the Al wires 221 and 222 in the stretching direction of the filaments 23 was about 0.2 mm, and the width of the Al wires 221 and 222 where the fixing portions 223 was not formed was about 0.3 mm. The Al wires 221 and 222 having the diameters of 0.4 mm were crushed flat to have width of about 0.5 mm to 0.6 mm at the time of forming the fixing portions 223. Furthermore, the difference of the height between the horizontal walls of the fixing portions 223 and the peripheral surfaces of the Al wires 221 and 222 was about 0.2 mm.

A ternary carbonate (Ba, Sr, Ca), as an electron emission material, coated on a core, such as a tungsten wire or a tungsten alloy wire made of rhenium and tungsten or the like, was used for the filament 23. A tungsten core having the thickness of 0.3 MG (or about 10 μm in diameters) to 7.53 MG (or about 50 μm in diameters) can be used as a core of the filament 23. However, the tungsten core having the thickness of 0.64 MG (or about 15 μm in diameters) was used in this embodiment. The diameter of the tungsten core after coating the electron emitting material was 30 μm.

The spacing between the filament 23 and the substrate 111 was set to about 0.3 mm. The spacing between each of the filaments 23 was set to about 0.8 mm to 3 mm. Although the spacing between the filament 23 and the substrate 111 is determined by the height of the Al wires 221 and 222 after being fixed to the substrate, the spacing can be set to be an appropriate value by changing the output of ultrasonic waves from the ultrasonic bonding apparatus, a joining time, and the load of the ultrasonic boding tool, as long as the thickness of the Al wires 221 and 222 before ultrasonic bonding are the same. In place of the Al thin films 211 and 222, thick films having a thickness of 10 μm or more may be formed on the substrate 111 by thick film printing.

The Al wires 221 and 222 are the fixing member of the filament 23, as well as the spacer for sustaining the filament 23 at the predetermined height. Thus, it is unnecessary to provide the fixing member and the spacer member for the filament 23 separately, as in the prior art fluorescent display tube. According to the present invention, the fixing member and the spacer member for the filament 23 are integrated so as to eliminate the space for placing the conventional spacer in the fluorescent display tube. Thus, the dead space in the fluorescent display tube can be reduced so that a compact fluorescent display tube can be obtained. More specifically, the interval between the Al wire 221 and the side plate 122, and the interval between the Al wire 222 and the side plate 124 can be set to about 1 mm. Furthermore, the fixing member for the filament 23 and the spacer member for the filament 23 are integrated, which results in reduction of the number of components, and the manufacturing costs of the fluorescent display tube.

Figure 8A:
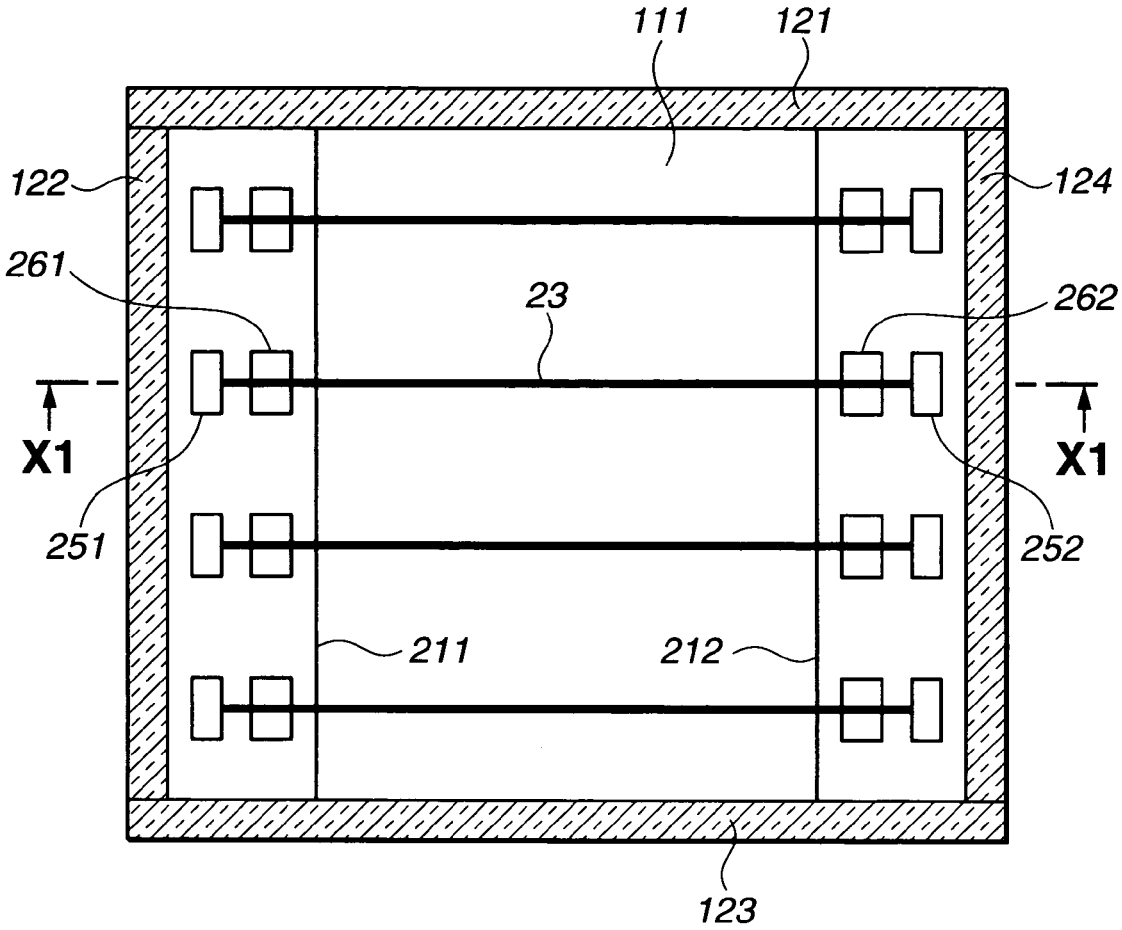
FIG.8(a) (PRIOR ART)
FIGS. 8(*a*) and 8(*b*) are cross sectional views, each showing a conventional fluorescent display tube.
Figure 8B:
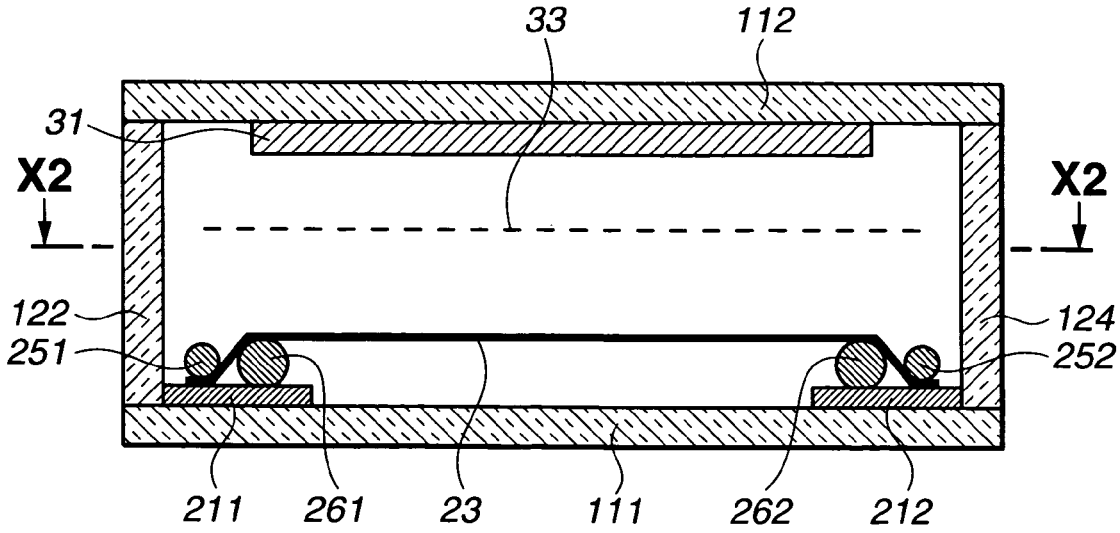
FIG.8(b) (PRIOR ART)

As shown in FIGS. 8(*a*) and 8(*b*), the conventional fluorescent display tube is provided with two Al wires 251 and 261 or 252 and 262 at each end of the filaments 23 for fixing and spacing the filaments 23. As a result, the end of the filament 23 generates heat due to the provision of the two Al wires. On the other hand, the fluorescent display tube of the present invention is provided with only one Al wire 221 or 223 at each end of the filaments 23. Thus, the heat to be generated from the ends of the filaments 23 will be reduced to half. As a result, the range of the end cool of the fluorescent display tube can be smaller, and the effective display area of the fluorescent display tube can be larger than that of the conventional fluorescent display tube. Also, the power consumption can be smaller than that of the conventional fluorescent display tube.

FIGS. 2(*a*) to 2(*f*) illustrate ultrasonic bonding of the filament 23. FIGS. 2(*a*) to 2(*f*) show fragmental views of the fluorescent display tube corresponding to the Al thin film 211 and the Al wire 221 taken along the line Y1-Y1 of FIG. 1(*a*). The Al thin film 212 and the Al wire 222 (not shown) are bonded in the same manner as shown in FIGS. 2(*a*) to 2(*f*). FIGS. 2(*b*), 2(*d*) and 2(*f*) are cross sectional views taken along the line Y3-Y3 of FIGS. 2(*a*), 2(*c*) and 2(*e*) looking in the direction of the arrow, respectively.

As shown in FIGS. 2(*a*) and 2(*b*), the Al wire 221 is placed on the Al thin film 211 on the substrate 111. A recessed portion 511 of an ultrasonic bonding tool (a wedge tool) 51 is pressed against the Al wire 221, and an ultrasonic wave is applied to the ultrasonic bonding tool 51 to bond the Al wire 221 to the Al thin film 221. Next, the filament 23 is placed on the Al wire 221 as shown in FIGS. 2(*c*) and 2(*d*) so that a flat end surface of an ultrasonic bonding tool 52 may be pressed against the filament 23 and the Al wire 221. Then, an ultrasonic wave is applied to the ultrasonic bonding tool 52 to fix the filament 23 to the Al wire 221.

The cross section of the filament 23 and the Al wire 221 is of a shape as shown in FIGS. 2(*e*) and 2(*f*). The filament 23 is embedded in a horizontal wall 2231 and a vertical wall 2232 of the stepped fixing portion 223 of the Al wire 221. The filament 23 is bent in a letter Z or in an inverted letter Z at the end thereof, and extends in the direction of stretching the filament 23.

The filament 23 is completely embedded in the horizontal wall 2231 and the vertical wall 2232. It is to be noted that the fixing strength equal to or more than the breaking down strength of the filament 23 can be obtained, even if a part of the embedded portion of the filament 23 is exposed. The filament is embedded in the fixing portion in three modes. First, the filament 23 located in the fixing portion 223 having the horizontal wall 2231 and the vertical wall 2232 is completely embedded in the fixing portion 223 and the filament 23 located in the fixing portion is not exposed at all. Second, the filament 23 located in the fixing portion 223 is partially embedded in the fixing portion 23 and a part of the filament is exposed from the fixing portion 223. Third, a part the filament 23 located in the fixing portion 223 is completely embedded not to be exposed from the fixing portion 223 at all and the other part of the filament 23 located in the fixing portion 223 is partially embedded in the fixing portion 223 so that a part of the filament is exposed from the fixing portion 223.

It is to be noted that the filament 23 is bent at substantially the right angle at the upper edge of the vertical wall 2232 in the direction of stretching the filament 23. Thus, the bent portion is hooked at the upper edge of the vertical wall 2232, which makes it difficult for the filament 23 to come out from the fixing portion 223, and the fixing strength of the filament 23 against pulling force in the direction of the filament 23 is significantly enhanced.

In the embodiment shown in FIGS. 2(*a*)-2(*f*), two different kinds of ultrasonic bonding tools 51 and 52 are used at the time of fixing the Al wire 221 to the Al thin film 211 and fixing the filament 23 to the Al wire 221. However, it is possible to perform the fixing of the Al wire 221 and the filament 23 by using the same ultrasonic bonding tool 51 using the flat portion of the ultrasonic bonding tool 51 at which the recessed portion 511 is not formed at the time of fixing the filaments 23 to the Al wire 221. The ultrasonic bonding tools 51 and 52 are driven to shift from one filament to other filament 23 in order. However, an ultrasonic bonding tool having a structure for bonding a plurality of the filaments 23 at the same time may be used.

In the filament 23, the ternary carbonate is coated on the core thereof. However, the ternary carbonate may be removed in advance or may not be removed, because it is easily rubbed off upon bonding.

In the embodiment shown in FIGS. 2(*a*)-2(*f*), the output of the ultrasonic bonding apparatus was 15 watts. The load applied by the ultrasonic bonding tools 51 and 52 was 1,100 g, and the bonding time was 250 milliseconds. Each of the ultrasonic bonding apparatuses of FIGS. 2(*a*) and 2(*b*) may be operated in the same condition or operated in a different condition. The bonding strength between the Al thin film 211 and the Al wire 221 was about 20 N, and the bonding strength between the filament 23 and the Al wire 221 was equal to or more 0.5 N of the wire breaking strength of the filament 23. Thus, the bonding strength between the filament 23 and the Al wire 221 is larger than the wire breaking strength of the filament 23, and the bonding strength is sufficient for fixing the filament 23.

FIGS. 3(*a*) to 3(*d*) show an embodiment for fixing the Al wires 221 and the fixing of the filaments 23 at the same time. FIGS. 3(*b*) and 3(*d*) are cross sectional views taken along the lines Y3-Y3 in FIGS. 3(*a*) and 3(*c*) looking in the direction of the arrow.

In this embodiment, the Al wire 221 is placed on the Al thin film 211 on the substrate 111, and the filament 23 is placed on the Al wire 221 as shown in FIGS. 3(*a*) and 3(*b*). The flat end surface of the ultrasonic bonding tool 52 is pressed against a part of the filament 23 and the Al wire 221 corresponding to the filament 23. Then, an ultrasonic wave is applied to the ultrasonic bonding tool 52 to fix the Al wire 221 to the Al thin film 211 and the filament 23 to the Al wire 221 at the same time.

The cross section of the fixed filament 23 and the fixed Al wire 221 is of a shape as shown in FIGS. 3(*c*) and 3(*d*). The filament 23 is embedded in the fixing portion 223 of the Al wire 221, and the end of the filament 23 is bent in a letter Z or in an inverted letter Z.

In this embodiment, the Al wire 221 not pressed by the ultrasonic bonding tool 52 is not fixed to the Al thin film 211. Thus, the fixing area of the Al wire 221 is smaller than the area where the ultrasonic bonding tool 52 is pressed against the entire Al wire 221, and the fixing strength of the Al wire 221 is reduced. However, the fixing strength of the Al wire 221 to the Al thin film 211 is still larger than the wire breaking strength of the filament 23. Accordingly, no problem is occurred in fixing the filament 23.

In the embodiment of FIGS. 3(*a*)-3(*d*), the fixing of the Al wire 221 and the fixing of the filament 23 is performed at the same time so as to simplify the fixing process of the Al wire 221 and the filament 23. In addition, the Al wire 221 not fixed to the Al thin film 211 is not crushed by the ultrasonic bonding tool 52 so that the filament 23 is supported at a height equivalent to the diameter of the Al wire 221 before the bonding. In other words, the height of the spacer of the filament 23 is determined by the diameter of the Al wire 221 before bonding, which makes it easy to decide the height of the spacer.

FIGS. 4(*a*) to 4(*d*) show another embodiment for performing the fixing of the Al wire 221 and the filament 23 at the same time. In this embodiment, the fixing area of the filament 23 is made to be larger than the area shown in FIGS. 3(*a*)-3(*d*). FIGS. 4(*b*) and 4(*d*) are cross sectional views taken along the line Y3-Y3 in FIGS. 4(*a*) and 4(*c*) looking in the direction of the arrow.

In FIGS. 4(*a*) and 4(*b*), the Al wire 221 is placed on the Al thin film 211 on the substrate 111, and the filament 23 is placed on the Al wire 221 to bond the filament 23 and the Al wire 221 with the ultrasonic bonding tool 53 at the same time similar to the embodiment shown in FIG. 3(*a*)-3(*d*). The ultrasonic bonding tool 53 having a recessed portion 531 for forming a projected portion 224 in the Al wire 221 acting as a spacer for the filament 23 is used. The ultrasonic bonding tool 53 is pressed against the entire area of the Al wire 221, and an ultrasonic wave is applied to the ultrasonic bonding tool 53 so that the Al wire 221 and the filament 23 are fixed to the Al thin film 211 and the Al wire 221 at the same time. The recessed portion 531 of the ultrasonic boding tool 53 has a depth in which the Al wire 221 may touch or may not touch the top portion thereof when the projected portion 224 is formed on the Al wire 221. The height of the projected portion 224 is almost the same as the diameter of the Al wire 221 in the case where the Al wire 221 does not touch the top portion of the recessed portion, and the height of the projected portion 224 is regulated by the depth of the recessed portion 531 in the case where Al wire 221 touches the top portion of the recessed portion.

The cross section of the fixed filament 23 and the fixed Al wire 221 is of a shape as shown in FIGS. 4(*c*) and 4(*d*). The filament 23 is embedded in the fixing portion 223 of the Al wire 221, and the end of the filament 23 is bent in a letter Z or in an inverted letter Z. The filament 23 is sustained at a predetermined height by the projected portion 224.

In the embodiment of FIGS. 4(*a*)-4(*d*), the Al wire 221 and the filament 23 can be bonded at the same time, and the fixing area of the Al wire 221 can be increased.

In the embodiment shown in FIGS. 2(*a*)-4(*d*), the Al wire 221, being processed in advance in the shape of a metal piece, was used. However, the Al wire 221 can be prepared by cutting the long linear bonding wire after it is fixed to the Al thin film 211 or 212 by ultrasonic wire bonding.

FIGS. 5(*a*) to 5(*f*) show another embodiment for arranging the Al wire 221 in the lengthwise direction of the filament 23 to fix the filament 23 to the Al wire 221. FIGS. 5(*b*), 5(*d*) and 5(*f*) are cross sectional views taken along the line Y3-Y3 in FIGS. 5(*a*), 5(*c*) and 5(*e*) looking in the direction of the arrow.

In the embodiment shown in FIGS. 5(*a*) and 5(*b*), the Al wire 221 is placed on the Al thin film 211 on the substrate 111 in order that the lengthwise directions of the Al wire 221 may be parallel to the direction of stretching the filament 23. The recessed portion 511 of the ultrasonic bonding tool 51 is pressed against the Al wire 221, and an ultrasonic wave is applied to the ultrasonic bonding tool 51. Then, the Al wire 211 is fixed to the Al thin film 221. Subsequently, the filament 23 is placed on the Al wire 221 in order that the filament 23 may be parallel to the lengthwise direction of the Al wire 221 as shown in FIGS. 5(*c*) and 5(*d*), and the flat end surface of the ultrasonic bonding tool 52 is pressed against the filament 23 and the Al wire 221. Then, an ultrasonic wave is applied to the ultrasonic bonding tool 52 to fix the filament 23 to the Al wire 221.

The cross section of the fixed Al wire 221 and the fixed filament 23 is of a shape as shown in FIGS. 5(*e*) and 5(*f*). The filament 23 is embedded in the fixing portion 223 of the Al wire 221, and the end of the filament 23 is bent in a letter Z or in an inverted letter Z.

In the embodiment shown in FIGS. 5(*a*)-5(*f*), the Al wire 221 and the filament 23 are arranged in such a manner that their lengthwise directions are oriented in the same directions (in parallel). Thus, each of the Al wires 221 can be arranged more closely to each other. As a result, the filaments 23 can be arranged in a fine pitch.

FIGS. 6(*a*) to 6(*d*) show a detailed structure of the filament 23 for use in the fluorescent display tube of FIGS. 1(*a*) and 1(*b*). The filament 23 shown in FIG. 6(*a*) is formed in a coil shape along the entire length wound at the same pitch. The filament 23 shown in FIG. 6(*b*) is formed in a coil shape along the entire length wound at partially different pitch. The filament 23 shown in FIG. 6(*c*) is formed of coil sections and a straight section. The filament 23 shown in FIG. 6(*d*) is formed of a straight section over the length.

As shown in FIGS. 6(*a*)-6(*c*), the coil section is formed on the linear member such as the filament 23 to apply tension to the linear member. In the case where the linear member is, for example, a cathode filament, even if the filament extends when the filament is electrically heated, the extension is absorbed by the coil section. Consequently, the filament is prevented from relaxing and contacting with electrodes such as the grid. This is applicable to the case where the linear member is a wire grid. When the linear member is used as a filament damper, the coil section as shown in FIGS. 6(*a*)-6(*c*) is not required, because of no need of electric heating in the filament damper. As shown in FIG. 6(*d*), the straight filament along the entire length may be used for the filament damper.

When the straight filament 23 to be tightly stretched on the jig is used, there is no need to provide the coil part in the filament. In stead of the coil part, a liner damper may be provided.

Figure 7A:
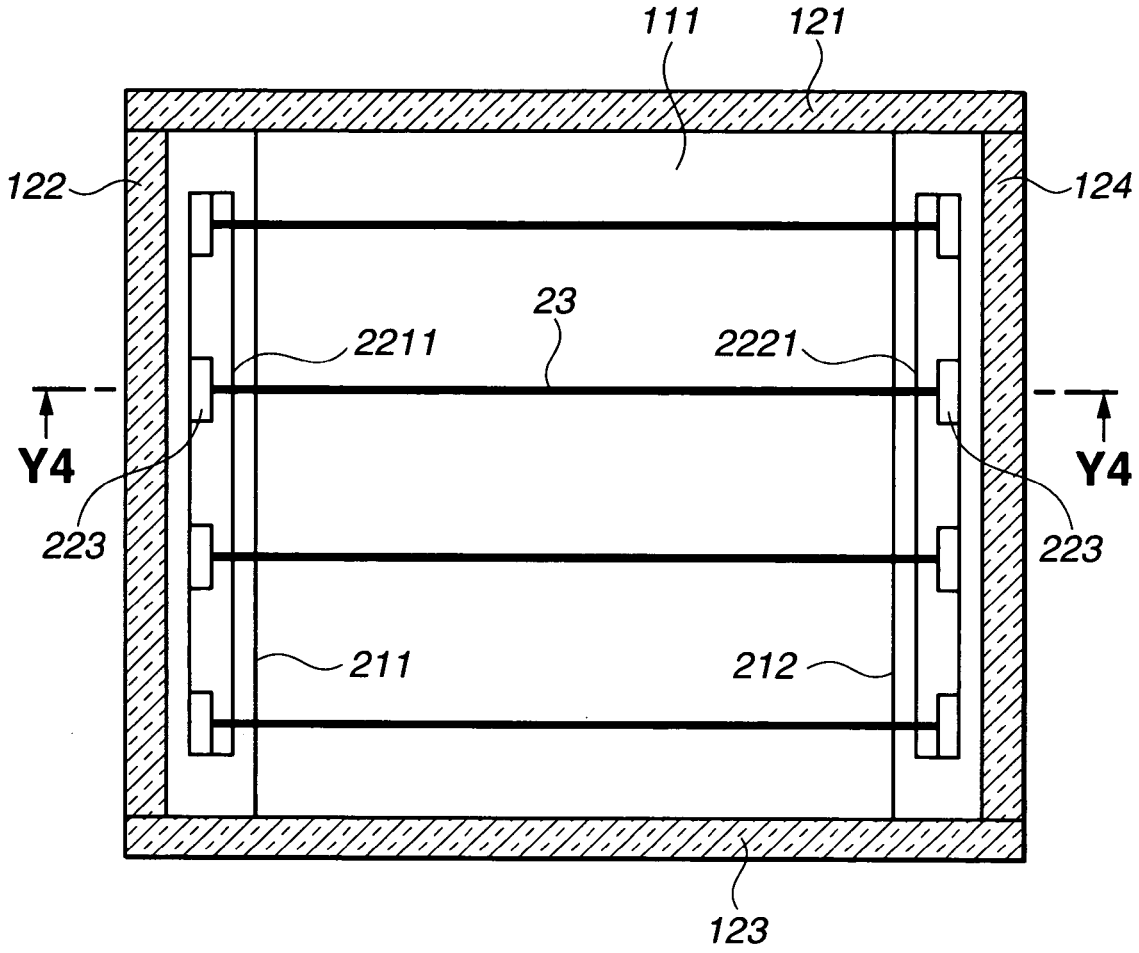
FIGS. 7(*a*) and 7(*b*) are cross sectional views, each showing a fluorescent display tube according to a second embodiment of the present invention.
Figure 7B:
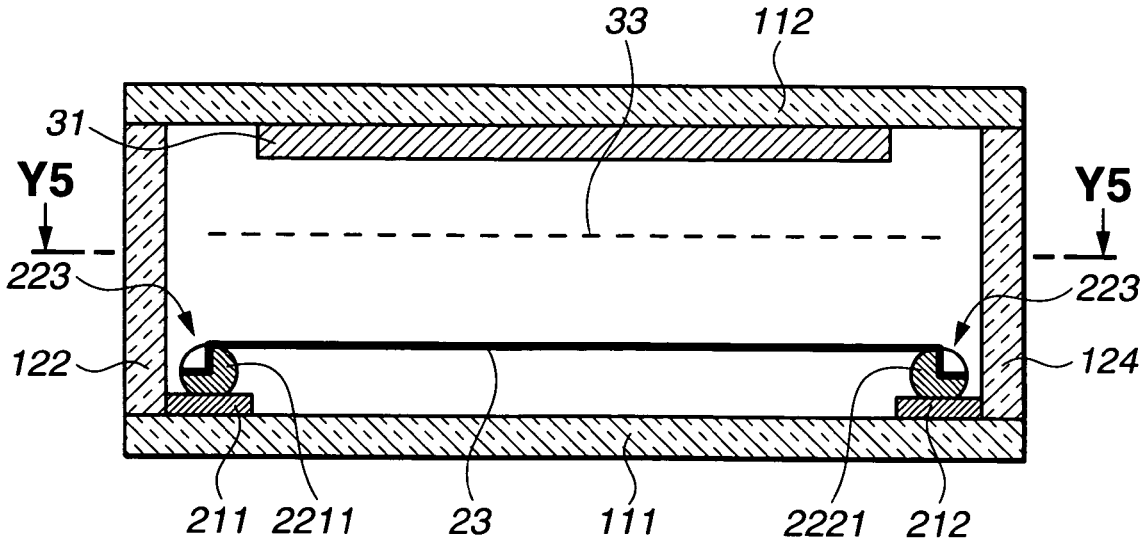

FIGS. 7(*a*) and 7(*b*) are cross sectional views showing a fluorescent display tube according to an alternative embodiment of the present invention. FIG. 7(*a*) is a cross sectional view of the fluorescent display tube taken along the line Y5-Y5 in FIG. 7(*b*) looking in the direction of the arrow. FIG. 7(*b*) is a cross sectional view of the fluorescent display tube taken along the line Y4-Y4 in FIG. 7(*a*) looking in the direction of the arrow. FIGS. 7(*a*) and 7(*b*) show an embodiment of the fluorescent display tube using the Al wires 221 and 222 which are different in length from the Al wires 221 and 222.

In the fluorescent tube shown in FIGS. 7(*a*) and 7(*b*), both ends of the filaments 23 are fixed to common Al spacer wires 2211 and 2221. The Al wires 2211 and 2221 are fixed on the Al thin films 211 and 212 on the substrate 111. The ends of the filaments 23 are fitted in the Al wires 2211 and 2221 at the positions where the filaments 23 are fixed. Then, the ends of the filaments 23 are bonded thereto by ultrasonic bonding.

In this case, the Al wires 2211 and 2221 are not required to be cut separately. Accordingly, when a lot of the filaments 23 are arranged in parallel at a fine pitch, the operation time for arranging the filament can be shortened. Further, the Al wires 2211 and 2221 can be used as a cathode electrode to compensate the current capacities of the Al thin films 211 and 212, which makes it possible to use the Al thin films 211 and 212 of narrow width and decrease the spaces for forming the Al thin films 211 and 212. This is also applicable to the wire grid or the like.

In this embodiment, the Al wires 2211 and 2221 are formed in common to all of the filaments 23. However, the Al wires may be divided into several segments, each of which a plurality of filaments 23 are fixed. For example, it is possible to divide four filaments 23 into upper and lower two groups each including two filaments 23, for which the Al wire is formed to each group of the filaments 23.

In the embodiments explained hereinabove, the descriptions have been given to the fixing portion for the filaments having stepped surfaces having the horizontal wall and the vertical wall formed on the Al spacer wire. However, the stepped portions may be of a sawtooth shape, an uneven shape, a stairstep shape, a curved shape or the like. Further, the fixing portion for the filament is not necessarily formed at one or several positions of the end of the Al spacer wire. The fixing portions of the filaments may be formed at one or several positions of an intermediate position of the Al spacer wire. Also, the filament is not necessarily fixed to the Al wire bonded to the Al thin film. Any metals, such as Cu, Au, Ag, N1, Pt, V, or an alloy, which is easily processed and bonded, may be used instead of the Al wire and Al thin film. Further, the Al wire is not necessarily in the shape of wire. Any conductive blocks capable of sustaining the filament at a predetermined height can be used. According to the present invention, the conductive block and the Al wire are referred to as a conductive spacer. Also, the Al thin film is not limited to a thin film. The film may be a metal layer including the thin film and thick film. The metal layer is referred to as a conductive layer in the present invention. The conductive layer can be formed on electronic components of the electron tube disposed inside the hermetic container via an insulating layer. The electronic component may be made of the same material as the conductive layers. The conductive spacer and the conductive layer are made of the same kind of metal, such as Al or Al alloy, in view of the bonding strength. However, it is most preferable to use the same metal, such as Al alloy, for the conductive spacers and for the conductive layers.

In the embodiments explained hereinabove, descriptions have been given to the method of fixing the filament by ultrasonic bonding. However, the filament is not limited to fixing by ultrasonic bonding. Also, it is possible to fix not only the filament but also the linear member to be sustained at a predetermined height, such as, a liner grid, a linear damper and a linear spacer for preventing vibration of the filament or the linear grid, and linear getter. Further, the present invention is not limited to the fluorescent display tube having a triode tube structure. The fluorescent display tube may have a diode tube structure having no grid or a multi-electrode tube structure having two grids or more. According to the present invention, the linear member is not limited to mounting on the first substrate. The liner member may be fixed to the second substrate or side plates inside the fluorescent display tube. It is to be understood that the linear member is not necessarily disposed in alignment with the outer end of the conductive spacer. The end of the linear member may be protruded out from the conductive spacer or may be positioned on the inside of the conductive spacer as long as the linear member can be fixed. The linear member is not limited to fix at the end of the conductive spacer.

Furthermore, the present invention is not limited to the fluorescent display tube. The present invention is applicable to electron tubes, such as a fluorescent luminous tube having fluorescent luminous elements with a large screen, a display tube such as a cathode-ray tube, a discharge tube such as a thermionic cathode discharge tube, and a vacuum electron tube which is provided with the linear members, such as filaments, linear grids, linear spacers, linear dampers, or linear getters, sustained in a predetermined height.

In the electron tube of the present invention, the linear member is bent and embedded in the fixing portions of the conductive spacer when the linear member is fixed to the conductive spacer. Consequently, the bent portion of the linear member is hooked at the edge of the fixing portion, which makes it difficult for the linear member to come out from the fixing portion. Furthermore, contacting areas of the fixing portion increase due to the bending. As a result, the fixing strength of the linear member against a pulling force in the stretched direction of the linear member is increased.

In the electron tube of the present invention, the linear member can be sustained at the predetermined height while the linear member is fixed to the conductive spacer fixed on the conductive layer, such as, the Al thin film. This structure makes it unnecessary to dispose the holding member for sustaining the linear member at the predetermined height and the fixing member separately, which are required in the conventional electron tube. According to the present invention, a single conductive spacer works as both the height level holding member and the fixing member. Thus, the smaller space for disposing the height level holding member and the fixing member is required in the electron tube, thereby, the smaller size electron tube can be provided. According to the present invention, the height holding member and the fixing member can be made of a single conductive spacer, which decreases the fixing steps and the number of components and reduce the fabrication costs of the electron tube. Also, the same ultrasonic bonding machine can be used to bond the linear member and the conductive spacer in a single step. This permits the linear member and the conductive spacer to be fixed effectively and easily and the fixing work time can be shortened. According to the present invention, the conductive spacer and the liner member are arranged in order that their lengthwise directions may become the same directions. Accordingly, the interval between adjoining linear member can be decreased, and the linear member can be arranged at a fine pitch.

In an alternative embodiment, the conductive material and the linear member are arranged in order that their lengthwise directions may be intersected with each other. In this instance, it is not required to cut the conductive spacer in pieces, and a large number of the linear member can be arranged in a fine pitch in a shorter working time. Further, ultrasonic bonding used to bond the conductive spacer does not generate heat at the bonding. Therefore, the electron tube of the present invention is free from the problem of damaging electric element in the electron tube due to the heat generated during the manufacture of the electron tube. According to the present invention, only one conductive spacer is provided at the end of the linear member. Thus, the quantity of radiant heat at the end of the linear member is small, which results in reducing the range of the end cool, enlarging the regions effective for display, and reducing the power consumption of the fluorescent display tube.

Obviously, many modifications and variations of the present invention are possible in the light of the above teachings. It is therefore to be understood that within the scope of the appended claims, the invention may be practiced otherwise than as specifically described.

What is claimed is:

1. An electron tube comprising:

a container for containing electrode therein;

a linear member mounted inside said container;

conductive spacers having stepped surfaces for fixing and keeping said linear member at a predetermined height in said container, said linear member being held by said conductive spacers to have at least one end of said linear member fixed to each of said conductive spacers; and conductive layers formed inside said container for fixing said conductive spacers thereon, wherein both ends of said linear member are fixed to said conductive spacers along said stepped surfaces.

2. The electron tube as defined in claim 1, wherein said linear member comprises a cathode filament, a linear damper, a linear spacer, a linear grid or a linear getter.

3. The electron tube as defined in claim 1, wherein said linear member is bonded to said fixing portion along said stepped surface thereof by ultrasonic bonding.

4. The electron tube as defined in claim 1, wherein said linear member is fixed to said fixing portion in a state in which at least a part of said linear member is embedded in said fixing portion.

5. The electron tube as defined in claim 1, wherein at least one of said ends of said linear member fixed to said fixing portion of said conductive spacers along said stepped surface of said fixing portion is bent to prevent said filament from coming out of said fixing portion.

6. The electron tube as defined in claim 5, in which said at least one of said ends of said linear member is bent to have a shape selected from the group consisting of a letter L and a letter Z.

7. An electron tube comprising:

a container for containing electrodes therein;

a linear member mounted inside said container;

conductive spacers for keeping said linear member at a predetermined height in said container, said conductive spacers each including a fixing portion having stepped surfaces, and said linear member being held by said conductive spacers to have at least one end of said linear member fixed to said fixing portion along said stepped surfaces of each of said conductive spacers; and conductive layers formed inside said container for fixing said conductive spacers thereon.

8. The electron tube as defined in claim 7, wherein said linear member comprises a cathode filament, a linear damper, a linear spacer, a linear grid or a linear getter.

9. The electron tube as defined in claim 7, wherein said linear member is bonded to said fixing portion along said stepped surface thereof by ultrasonic bonding.

10. The electron tube as defined in claim 7, wherein said linear member is fixed to said fixing portion in a state in which at least a part of said linear member is embedded in said fixing portion.

11. The electron tube as defined in claim 7, wherein at least one of said ends of said linear member fixed to said fixing portion of said conductive spacers along said stepped surface of said fixing portion is bent to prevent said filament from coming out of said fixing portion.

12. The electron tube as defined in claim 11, in which said at least one of said ends of said linear member is bent to have a shape selected from the group consisting of a letter L and a letter Z.

* * * * *

UNITED STATES PATENT AND TRADEMARK OFFICE

CERTIFICATE OF CORRECTION

PATENT NO. : 7,298,073 B2
APPLICATION NO. : 10/770173
DATED : November 20, 2007
INVENTOR(S) : Yonezawa et al.

It is certified that error appears in the above-identified patent and that said Letters Patent is hereby corrected as shown below:

Column 9, Line 58:
"N1" should be --Ni--

Signed and Sealed this

Seventeenth Day of June, 2008

JON W. DUDAS
*Director of the United States Patent and Trademark Office*